US005701558A

United States Patent [19]

Kojima

[11] Patent Number: 5,701,558

[45] Date of Patent: Dec. 23, 1997

[54] DEVELOPING APPARATUS FOR PREVENTING DEVELOPER FROM LEAKING FROM A DEVELOPER CONTAINER

[75] Inventor: Hisayoshi Kojima, Yokohama, Japan

[73] Assignee: Canon Kabushiki Kaisha, Tokyo, Japan

[21] Appl. No.: 347,097

[22] Filed: Nov. 23, 1994

[30] Foreign Application Priority Data

Nov. 25, 1993 [JP] Japan ..... 5-317548

[51] Int. Cl.[6] ..... G03G 15/08

[52] U.S. Cl. ..... 399/103

[58] Field of Search ..... 355/30, 215, 245, 355/251, 259, 261; 118/653, 656–658, 651, 661; 399/102, 105, 103

[56] References Cited

U.S. PATENT DOCUMENTS

| | | | |
|---|---|---|---|
| 5,057,868 | 10/1991 | Sekino et al. | 355/215 |
| 5,084,733 | 1/1992 | Katoh et al. | 355/251 |
| 5,134,960 | 8/1992 | Shirai | 118/653 |
| 5,166,733 | 11/1992 | Eliason | 355/251 |
| 5,202,729 | 4/1993 | Miyamoto et al. | 355/251 |
| 5,212,521 | 5/1993 | Ogawa et al. | 355/215 |
| 5,274,425 | 12/1993 | Fukumoto et al. | 355/215 |
| 5,389,732 | 2/1995 | Sekino | 118/653 |

*Primary Examiner*—Robert Beatty

*Attorney, Agent, or Firm*—Fitzpatrick, Cella, Harper & Scinto

[57] ABSTRACT

A developing apparatus includes a developer container, having an opening, for containing a developer, a developer carrying member in the opening, an elastic developer layer thickness regulating member, elastically press-contacted to the developer carrying member and extended along a length of the developer carrying member, for regulating a thickness of a layer of the developer on the developer carrying member, a pair of end seals, contacted to longitudinal end portions of the developer carrying member, for preventing movement of the developer to an end of the developer container wherein a surface of the pair of end seals adjacent to the regulating member are press-contacted to longitudinal end surfaces of the regulating member, and a developer scatter preventing sheet cooperating with the developer carrying member to form a nip permitting passage of the developer into the container while preventing scattering of the developer. The distance between the sealing members at the nip is larger than the distance therebetween at the regulating portion.

9 Claims, 7 Drawing Sheets

DEVELOPING APPARATUS FOR PREVENTING DEVELOPER FROM LEAKING FROM A DEVELOPER CONTAINER

FIELD OF THE INVENTION AND RELATED ART

The present invention relates to a developing apparatus for an image forming apparatus such as an electrophotographic type copying machine, printer or the like. More particularly, it is related to a prevention of leakage of developer from developer container.

A conventional developing apparatus comprises a sealing member for preventing leakage of developer at end portions of a developer container, and a developer scatter preventing sheet for preventing scattering of the developer collected into a container to the outside of the container in order to prevent leakage of the developer from the developer container.

Referring first to FIG. 8, there is shown a developing apparatus. FIG. 9 is a view of a sealing member as seen from a developing roller, and FIG. 10 shows the developing apparatus. During assembly of the developing apparatus, a developing roller 104 is urged by bearing members 105, by which the developer roller 104 is set in an opening of a developer container 101. A sealing member 102 of felt or the like is contacted to the surface of the developing roller along its rotational direction at each of the opposite ends thereof. The sealing member 102, as shown in FIG. 8, is disposed at each of the opposite opening portions to prevent leakage of the toner from the container thereat. An elastic film 103 is bonded to a bottom end of the opening to prevent the scattering of the developer from the container. The elastic film is contacted to the developing roller, and each of the sealing members is urged to the developing roller at the associated end of the film.

Adjacent the top of the opening, an elastic blade 106 is provided in contact with the developing roller to regulate a layer thickness of a layer of the developer to be formed on the developing roller and also to triboelectrically charge the developer. In order to prevent the developer from leaking through a gap between the blade and the sealing member, the sealing member is overlaid at a longitudinal end of the blade, as shown in FIG. 9, and in addition, the blade is urged toward the developing roller.

With this structure, however, if the blade is relatively thick, toner leakage tends to occur because of a gap S between the seal and the blade which may be formed when the pressure of the end seal 102 is not sufficient, as shown in FIG. 10. Particularly, in the case of non-magnetic toner, the magnetic confining force is not effective with the developer and results in more remarkable toner leakage.

In order to increase the toner sealing performance, the pressure of the end seal may be increased, or a blade having a very weak elastic force is used. However, in these cases, the torque required for the developing roller may be increased, and the contact pressure between the developing roller and the developing blade is non-uniform as shown in FIG. 11, with the result that the image density is insufficient at the opposite end portions where the contact pressure is high. The additional result is that at the portion slightly toward the central portion from the end where the contact pressure is low, the triboelectric charge of the toner is insufficient, and the toner layer thickness regulation is also insufficient, so that a foggy background is produced, and/or the toner tends to leak out.

On the other hand, particularly when non-magnetic toner is used, the toner is attracted to the developing roller only by an intermolecular force as compared with the magnetic toner, and therefore, the attraction force is very weak. If the scatter preventing sheet is contacted to the developing roller with high pressure, the toner is scraped out without being taken into the toner container. In addition, even if the overall pressure is low, end portions of the sheet are sandwiched between the developing roller and the end seals, and the contact pressure is high at the opposite ends of the sheets.

SUMMARY OF THE INVENTION

Accordingly, it is a principal object of the present invention to provide a developing apparatus wherein leakage of a developer from opposite ends of a developer container is effectively prevented, and contact pressure between a developing blade and a developer roller does not vary.

It is another object of the present invention to provide a developing apparatus in which a developer is efficiently returned into a toner container while effectively preventing toner leakage from the container.

According to an aspect of the present invention, there is provided a developing apparatus including: a developer container, having an opening, for containing a developer; a developer carrying member in the opening; an elastic developer layer thickness regulating member, elastically press-contacted to the developer carrying member and extended along a length of the developer carrying member, for regulating a thickness of a layer of the developer on the developer carrying member; an end seal member, contacted to a longitudinal end portion of the developer carrying member for preventing movement of the developer to an end of the developer container; wherein a surface of the end seal member adjacent to the regulating member is press-contacted to a longitudinal end surface of the regulating member.

According to another aspect of the present invention, there is provided a developing apparatus including: a developer container, having an opening, for containing a developer; a rotatable developer carrying member, in the opening, for carrying the developer; a developer scatter preventing sheet cooperating with the developer carrying member to form a nip permitting passage of the developer into the developer container and to prevent scattering of the developer out of the developer container; a seal member, press-contacted to each of opposite longitudinal ends of the developer carrying member, for preventing movement of the developer toward end portions of the developer container; wherein the seal member urges the sheet to the developer carrying member at a position of the nip, and wherein at the position of the nip, a distance between the seal members is larger than a width of a layer of the developer carried on the developer carrying member out of the container.

These and other objects, features, and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
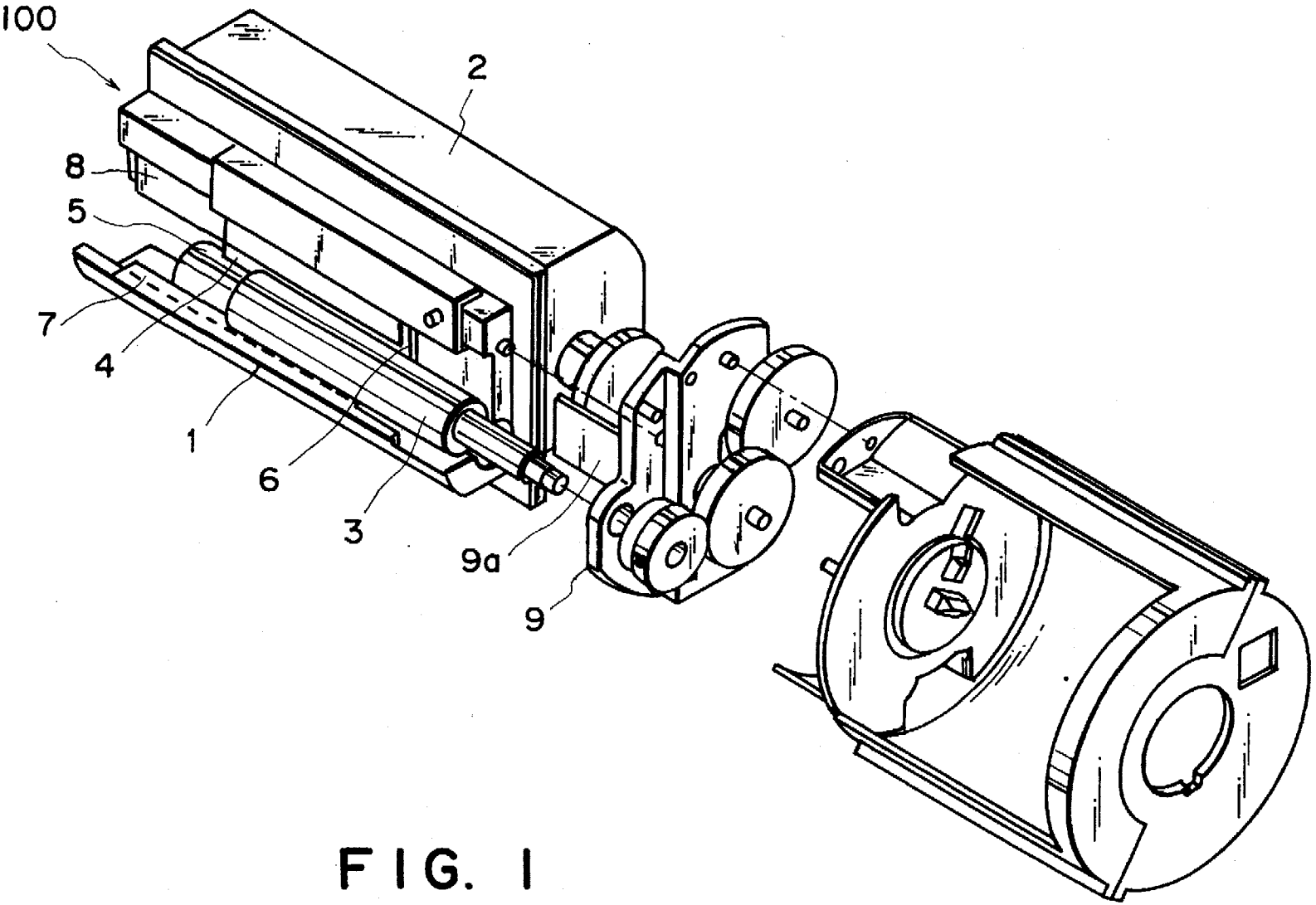
FIG. 1 is a perspective view of a developing apparatus according to a first embodiment of the present invention.
Figure 2:
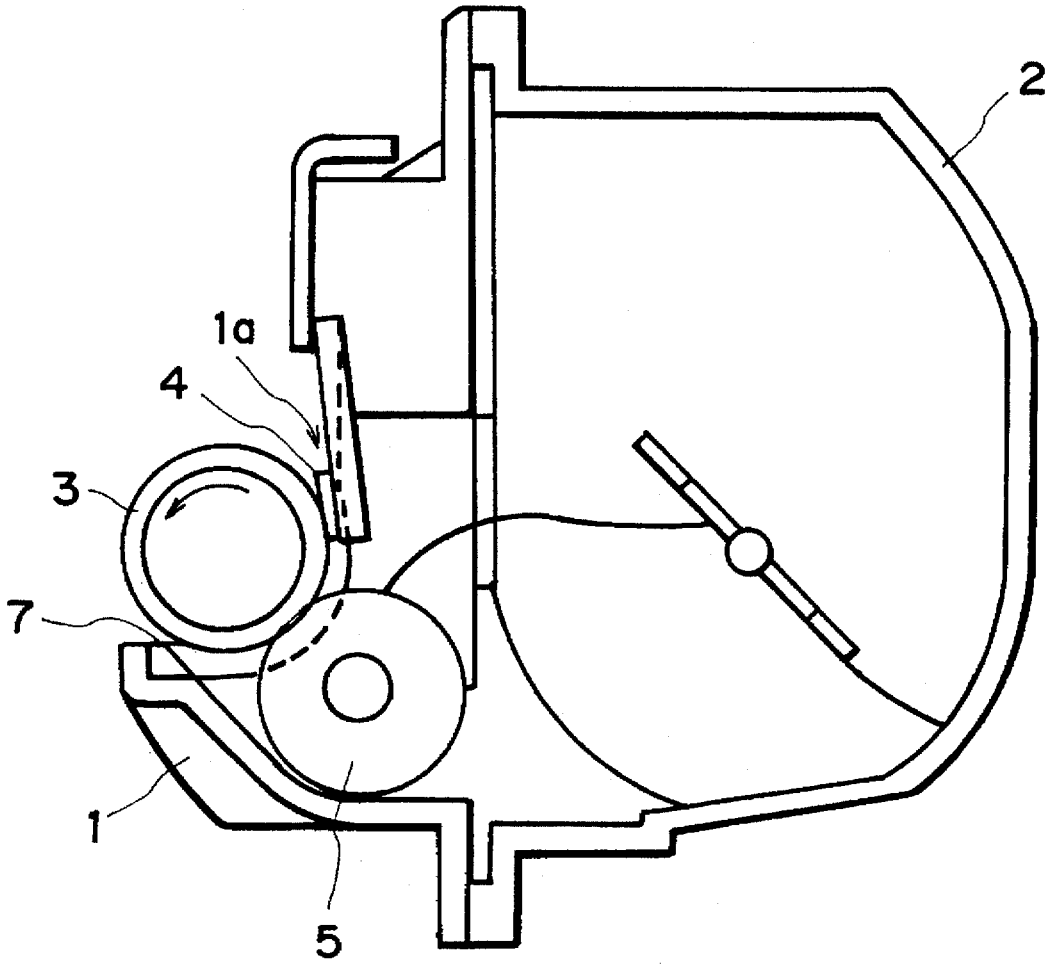
FIG. 2 is a sectional view of a developing apparatus of FIG. 1.
Figure 3A:
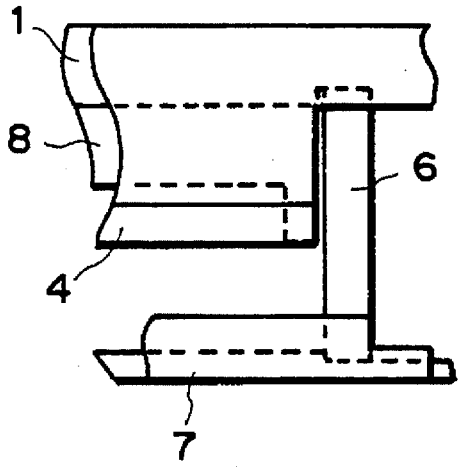
FIGS. 3(*a*) and 3(*b*) illustrates a major portion of the developing apparatus of FIG. 1.
Figure 3B:
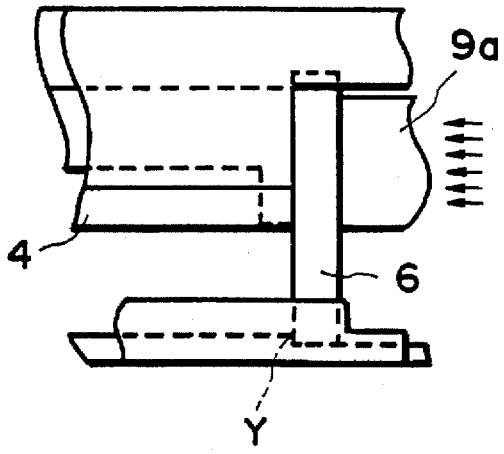

Referring first to FIGS. 1–3, a first embodiment of the present invention will be described. As shown in FIG. 1, a developing apparatus 100 of this embodiment comprises a developer container 1, a toner container 2, a developing roller 3 rotatably supported on the developer container 1 to be partly exposed through an opening 1*a* of the developer container 1, a blade 4 elastically pressed to the developing roller 3 to regulate a thickness of a thin layer of the toner and to apply triboelectric charge to the toner, a supply roller 5 for supplying the toner to the developing roller 3, an end seal 6 bonded to each of the longitudinal end portions of the opening 1*a* and press-contacted to a peripheral surface of the developing roller 3, a scatter preventing sheet 7, a back-up seal 8, and bearing members 9 for the developing roller 3 and the supply roller 5. The opening 1*a* is disposed downstream of the blade 4 with respect to the rotational direction of the developing roller 3. The scatter preventing sheet 7 is bonded to the bottom end of the opening 1*a* and is extended along the length of the opening 1*a* to prevent the toner from scattering by contact with the developing roller 3 at the free end thereof at a position downstream of the bottom of the opening 1*a*. The back-up seal 8 is bonded to the developer container 1 and lightly contacted to a backside of the blade 4 to reduce entrance of the toner to the top and end portions of the container.

The blade 4 comprises an elastic member of rubber or urethane rubber and a harder member of phosphor bronze, SUS or the like. The harder member is required to have a certain degree of hardness to prevent deformation of the blade upon pressure applied to a longitudinal end of the blade, and therefore, it is preferably made of thin metal plate such as phosphor bronze, SUS or the like plate.

The end seal 6 and back-up seal 8 are of a material effective to absorb pressure, such as felt, sponge or the like.

FIGS. 3(*a*) and 3(*b*) illustrate a relationship among the developer container 1, the blade 4, the end seal 6 and the scatter preventing sheet 7, as seen from the developing roller 3.

The end seal 6, as shown in FIGS. 3(*a*) and 3(*b*) is bonded to a position such that no gap or a small gap is initially provided relative to edges of the blade 4 end the back-up seal 8. The developing roller is set at a predetermined portion, and the bearing members 9 are set through the opposite ends. Then, as shown in FIG. 3(*b*), by an end seal pressure applying member 9*a* formed in the bearing member 9, an end surface of the end seal 6 that is nearer to the pressure applying member is pressed so that the blade side end is brought into press-contact to the longitudinal end surface of the blade 4. Here, the elastic blade comprises a rubber member supported by a harder member, and therefore, the deformation of the blade by the pressure applied by the longitudinal end surface of the blade, can be prevented.

As a result, the toner leakage is prevented at the longitudinal ends of the blade 4. Additionally, at the end portions of the blade, the end seal 6 does not urge the blade 4 toward the developing roller 3, and therefore, the contact pressure variation does not occur over the entire longitudinal length of the blade 4, and therefore, satisfactory images can be provided without non-uniformity of the image density.

Particularly when one component non-magnetic toner is used in, which the toner confining force of the developing roller is weak, toner leakage easily occurs if there is any gap. Therefore, the above-described elimination of the gap between the blade and the seal is particularly effective when the one component non-magnetic toner is used.

In this embodiment, an end seal pressing member 9*a* is formed in a bearing member, but if a structure is capable of pressing the end surface of the end seal, it need not necessarily be a bearing member.

When the developing apparatus is assembled, it is difficult to bond an end surface of the blade of the end seal 6 and a longitudinal end surface of the blade 4 with press-contacting from the beginning. In view of this, during the assembling operation, the end seal 6 is moved to press-contact the end surface of the end seal 6 and the end surface of the blade 4. This is convenient.

As described in the foregoing, according to this embodiment, the side end of the blade of the end seal is pressed to the longitudinal end surface of the developing blade, and therefore, the gap between the sealing member and the blade is eliminated, thus increasing the sealing effect. As a result, satisfactory sealing is accomplished at the blade side end surface of the end seal, and simultaneously, the end seal does not urge the blade toward the developing roller. Therefore, satisfactory image formation without foggy background and without density non-uniformity, is accomplished. As compared with the conventional method in which the end seal is urged (collapsed) at the backside of the blade, excessive contact pressure can be reduced at the opposite ends of the blade, so that the driving torque required for driving the developing roller can be reduced. Furthermore, the adverse influence to the image such as pitch non-uniformity or the like can be suppressed. The rated power of the driving source can be reduced, thus permitting cost reduction.

The scatter preventing sheet 7 is preferably of such a material that the attraction force between the scatter preventing sheet 7 and the toner is smaller than the attraction force between the developing roller 3 and the toner. The sheet has friction resistance relative to the developer smaller than the friction resistance between the developer carrying member and the developer. By, for example, roughening the surface of the sheet 7 to reduce contact area with the toner, the toner not used for the development does not enter the developer container, so that the liability of the leakage of the toner on the preventing sheet can be avoided.

Embodiment 2

Figure 4A:
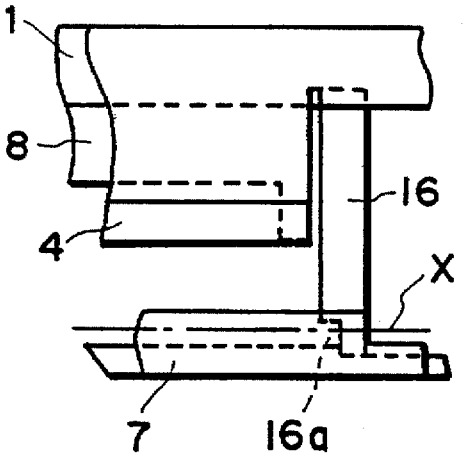
FIGS. 4(*a*) and (*b*) illustrates shows a major portion of a developing apparatus according to a second embodiment of the present invention.
Figure 4B:
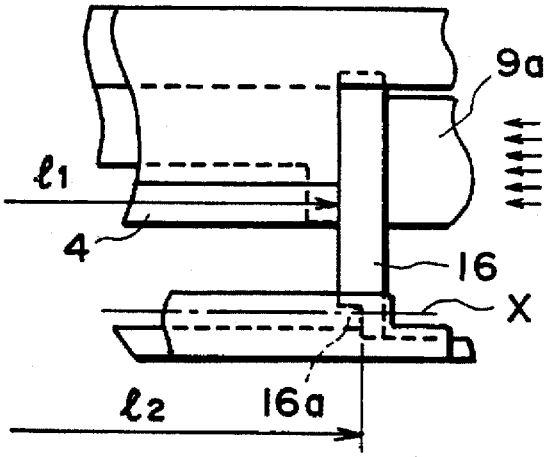

Referring to FIGS. 4(*a*) and 4(*a*), a second embodiment of the present invention will be described. The same reference numerals as in Embodiment 1 are assigned to the elements having the corresponding functions, and the detailed description thereof are omitted for simplicity.

FIGS. 4(*a*) and 4(*b*) illustrate a sealing particularly effective when the toner is non-magnetic.

Each of the opposite ends of the scatter preventing sheet 7 is urged to the developing roller 3 by the end seal 6.

In FIG. 3(*b*), for example, the contact pressure between the sheet 7 and the developing roller 3 is such that it is higher at a portion Y which is adjacent to the seal contact portion than the central portion of the sheet 7.

When the non-magnetic toner is used, the attraction force between the developing roller and the toner is very weak, and therefore, the toner is not taken into the container at Y portion, but is scraped out.

In order to reduce this effect at the Y portion, a toner passing width l2 is larger than the blade width measured in a longitudinal direction thereof, that is, a toner coating width l1. By doing so, the contact pressure of the scatter preventing sheet 7 is uniform in the toner coating width, in FIG. 4.

In FIG. 4, (*b*), designated by X is a nip formed between a developing roller 3 and a sheet 7, and the nip X is effective to permit passage of the developer into the developer container. A cut-away portion 16*a* of the end seal 16 is disposed downstream of the nip and upstream of the leading edge of the scatter preventing sheet. By doing so, the toner coating width is determined by the inner dimension of the end seals except for 16*a*. Therefore there is no possibility of the lateral leakage due to the toner entrance into the end seal.

As described in the foregoing, according to this embodiment, the distance between the end seals contacted to the scatter preventing sheets is larger than the toner coating width at the nip position, by which the contact pressure of the sheet to the toner along the length of the sheet is substantially uniform. As a result, as compared with the conventional method, the efficiency of collection of the toner back into the developer container can be increased, and in addition, the toner leakage can be prevented.

Embodiment 3

Figure 5A:
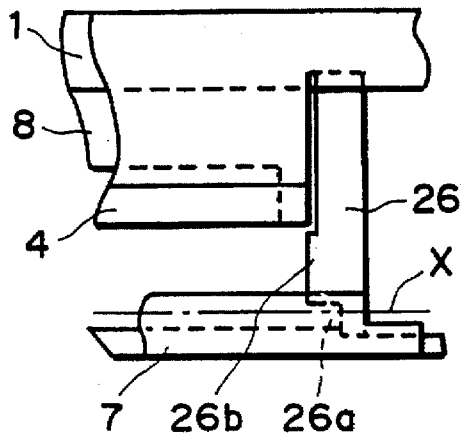
FIGS. 5(*a*) and (*b*) show a major portion of a developing apparatus according to a third embodiment of the present invention.
Figure 5B:
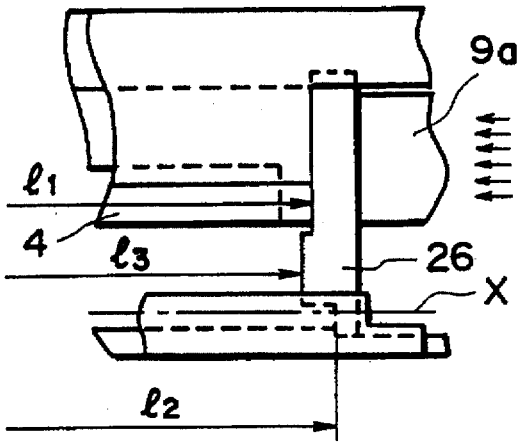

Referring to FIGS. 5(*a*) and 5(*b*), a third embodiment of the present invention will be described. The same reference numerals as in Embodiment 1 are assigned to the element having the corresponding functions, and the detailed descriptions thereof are omitted for simplicity.

The example of FIGS. 5(*a*) and 5(*b*), is particularly effective to seal a high flowability toner which promotes entrance of the toner into the end seal.

For example, with the structure of FIGS. 3(*a*), 3(*b*) and 4(*a*), and 4(*b*), the toner in the developer container directly flows into the inside wall of the end seal. When the high flowability toner is used, the toner enters easily into the end seal portion by the internal pressure, with the result of lateral leakage.

As shown in FIGS. 5(*a*) and 5(*b*), if the width of the end seal 26 is formed so as to satisfy l2>l1>l3, where l1 is a blade width, that is, a toner coating width, l2 is a toner passing width, and l3 is a portion 26*b* therebetween, then a large amount of the toner does not flow into the toner coating width l1 from the container, and therefore, the lateral motion of the toner over the toner coating width l1 can be prevented.

In this embodiment, when the end seal is bonded, zero gap or a small gap is provided relative to the longitudinal end surface of the blade 4, and an end surface of the end seal 26 is urged to the longitudinal end surface of the blade 4. This is advantageous.

Embodiment 4

Figure 6A:
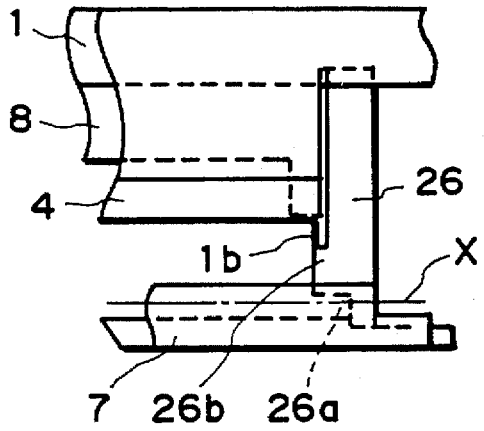
FIGS. 6(*a*) and (*b*) show a major portion of a developing apparatus according to a fourth embodiment of the present invention.
Figure 6B:
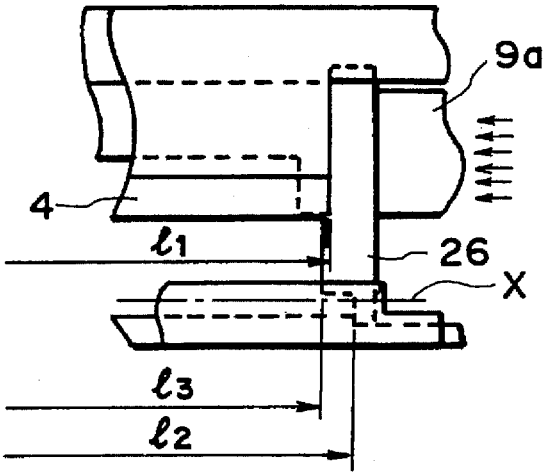

Referring to FIGS. 6(*a*) and (*b*), a fourth embodiment of the present invention will be described. The same reference numerals as in Embodiment 1 are assigned to the element having the corresponding functions, and the detailed description thereof are omitted for simplicity.

FIGS. 6(*a*) and 6(*b*) show an embodiment that is particularly effective for the sealing when the flowability of the toner is high, and therefore, the toner easily enters the end seal portion.

With the structures of FIGS. 3(*a*), 3(*b*), 4(*a*) and 4(*b*), the toner in the developer container directly flows toward the inner wall of the end seal from the developer container. When the flowability of the toner is high, the toner easily enters the end seal portion because of the internal pressure, with the result of lateral leakage.

As shown in FIGS. 6(*a*) and 6(*b*), a projection 1*b* adjacent to the developing roller 3 is formed at each end of the container opening. The width of the end seal 26 is determined so as to satisfy l2>l1>l4>l3, where l4 is a distance between the projections 1*b*, l1 is a blade width, that is, a toner coating width, l2 is a toner passing width, and l3 is a width 26*b* therebetween. Then, an end seal pressure applying member 9*a* formed on the bearing member 9 as described in Embodiment 1 urges the end surface of the end seal 26 that is nearer to the pressure applying member 9*a*, and end seal 26 contacts the longitudinal end surface of the blade, the longitudinal end surface of the back-up seal, and the projection 1*b*. Because the above-described width relations are satisfied, the portion of the end seal 26 corresponding to l4 is substantially pushed to the opening side beyond the longitudinal end surface of the blade, thus preventing a large amount of the toner from flowing into the longitudinal end portion of the blade. The portion corresponding to l3 functions to prevent the toner flowing from the beginning, and therefore, the lateral movement of the toner beyond the toner coating width l1 can be suppressed.

Embodiment 5

Figure 7A:
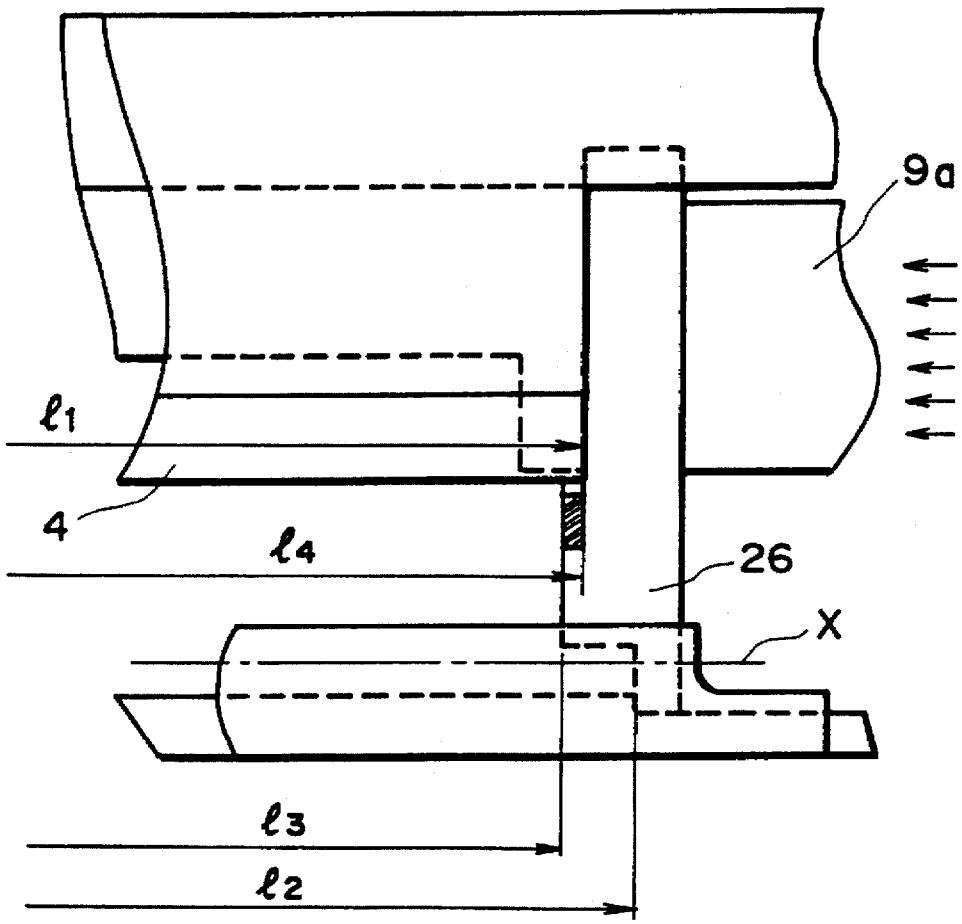
FIGS. 7(*a*) and 7(*b*) show a major part of a developing apparatus according to a fifth embodiment of the present invention.
Figure 7B:
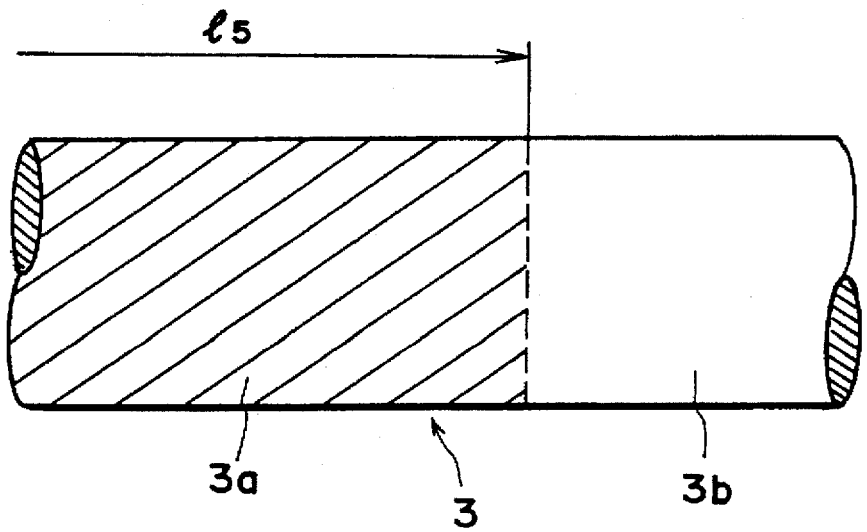
Figure 8:
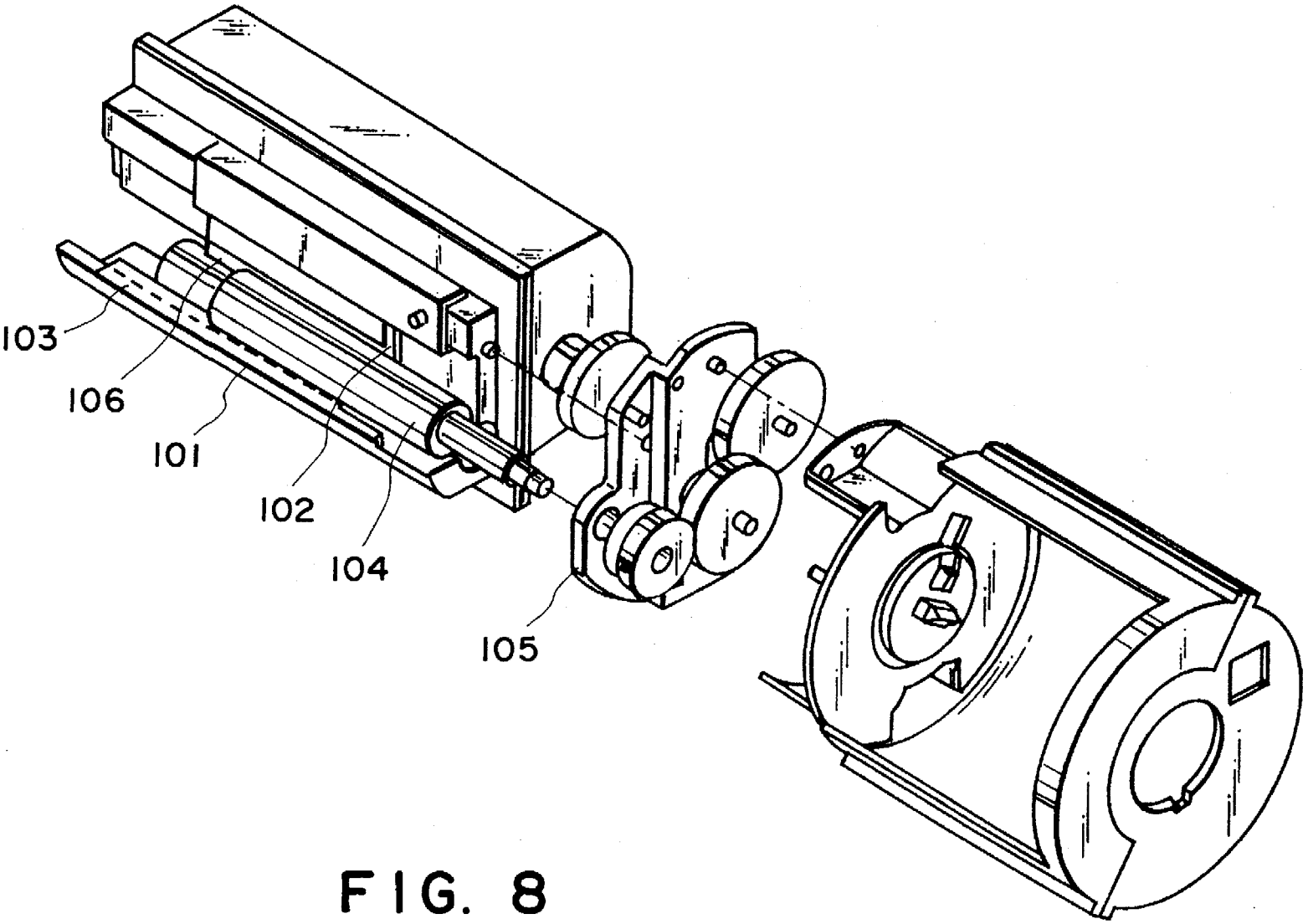
FIG. 8 is a perspective view of a developing apparatus.
Figure 9:
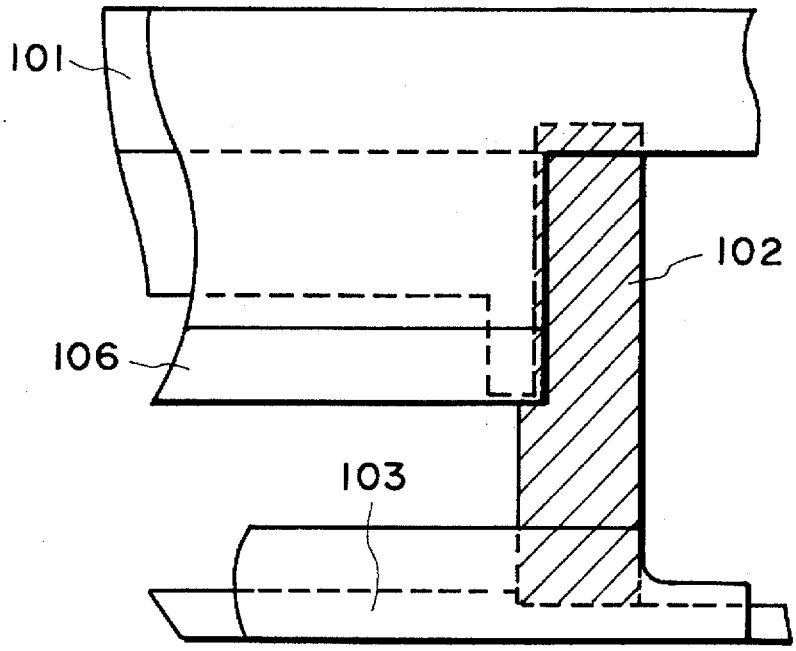
FIG. 9 shows a major portion of the developing apparatus of FIG. 8.
Figure 10:
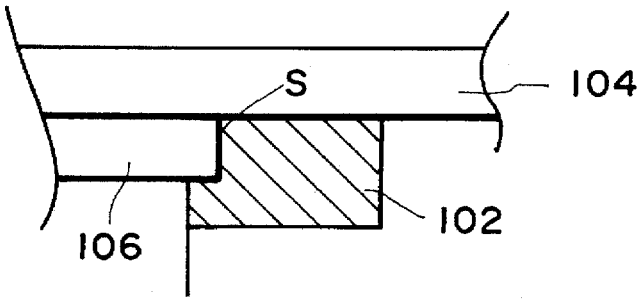
FIG. 10 illustrates a problem with the developing apparatus of FIG. 8.
Figure 11:
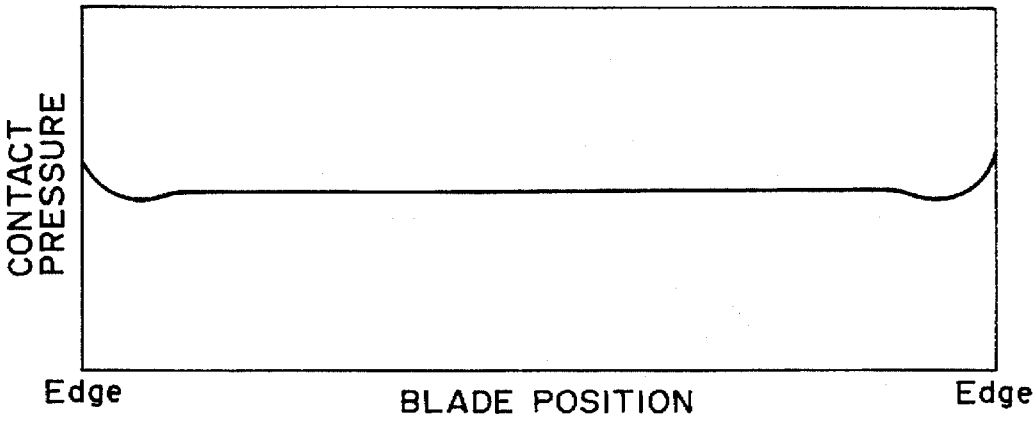
FIG. 11 illustrates a problem with the developing apparatus of FIG. 8.

Referring to FIGS. 7(*a*) and 7(*b*), a fifth embodiment of the present invention will be described. The same reference numerals as in Embodiment 1 are assigned to the elements having the corresponding functions, and the detailed description thereof are omitted for simplicity.

Usually, a surface of the developing roller 3 is roughened in an image formation area for the purpose of increasing a toner carrying performance and a toner charging performance. FIGS. 7(*a*) and 7(*b*) illustrate a width of the roughened surface which is suitably used with the toner sealing method of the present invention.

When the width is determined such that the end seal 26 is overlapped with the roughened portion 3*a*, the toner is applied on the entire area of the roughened surface 3*a* because the roughened surface has a strong toner carrying property. As a result, the toner enters the end seal portion, and therefore, it is very difficult to avoid toner leakage due to the lateral movement of the toner. If, on the other hand, the end seal 26 is not at all overlapped with the toughened portion 3*a*, the toner is applied tp the specular surface 3*b* of the developing roller 3. In this case, the toner carrying property of the developing roller 3 is very weak in the specular portion, and in addition, the toner charge is significantly unstable. Therefore, the problem of the foggy background and toner scattering tends to arise.

The widths of various portions are selected to satisfy l2>l1>l5>l3, where l5 is a width of the roughened portion, l1 is a blade width, that is, a toner coating width, l2 is a toner passing width, l3 is a width of a portion 26b between the end seals 26. Then, the width 3a of the toughened portion is smaller than the width of the developing blade 4, and therefore, the toner does not make the lateral movement beyond the blade width. The portion 26b closest to the bottom portion of the opening of the developer container, of the end sea 26, is inside of the width of the roughshod portion, and the toner is substantially uniform in this portion (rubbing). Therefore, the toner carrying performance is uniform, thus avoiding the above-described problem.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus comprising:

a developer container, having a developing opening, for containing a developer;

a rotatable developer carrying member, in the opening, for carrying the developer;

a regulating member for regulating an amount of the developer supplied out of said container on said developer carrying member;

a developer scatter preventing sheet cooperating with said developer carrying member to form a nip permitting passage of the developer into said developer container and to prevent scattering of the developer out of said developer container;

a pair of sealing members press-contacted to opposite ends of said developer carrying member, wherein said sealing members are provided along a circumferential direction of said developer carrying member over a regulating portion of said regulating member and the nip to press said sheet, wherein a width of a developer layer supplied out of said container substantially corresponds to a distance between said sealing members adjacent the regulating portion, and wherein the distance between said sealing members at the nip is larger than the distance therebetween adjacent the regulating portion.

2. An apparatus according to claim 1, at a downstream end of said sheet with respect to a rotational direction of said developer carrying member, the distance between said sealing members is smaller than a distance between said sealing members at the position of the nip.

3. An apparatus according to claim 1, wherein said developer layer thickness regulating member is elastically urged to said developer carrying member, and said sealing members are contacted to a longitudinal end surface thereof.

4. An apparatus according to claim 3, wherein at a downstream end position of said sheet with respect to a rotational direction of said developer carrying member, a distance between said sealing members is smaller than a width of said developer layer thickness regulating member in its longitudinal direction.

5. An apparatus according to claim 3, wherein a surface of said developer carrying member has a roughened portion, and a width of the roughened portion is smaller than a width of said developer layer thickness regulating member in its longitudinal direction, and is larger than a distance between said sealing members at a downstream end position of said sheet with respect to a rotational direction of said developer carrying member.

6. An apparatus according to claim 1, wherein the developer is non-magnetic developer.

7. An apparatus according to claim 6, wherein the non-magnetic developer is a one component developer.

8. An apparatus according to claim 1, wherein said sheet has a friction resistance relative to the developer which is smaller than a friction resistance between said developer carrying member and the developer.

9. A developing apparatus comprising:

a developer container, having an opening, for containing a developer;

a rotatable developer carrying member, in the opening, for carrying the developer;

a developer scatter preventing sheet cooperating with said developer carrying member to form a nip permitting passage of the developer into said developer container and to prevent scattering of the developer out of said developer container;

a seal member, press-contacted to each of opposite longitudinal ends of said developer carrying member, for preventing movement of the developer toward end portions of said developer container;

wherein said seal member urges said sheet to said developer carrying member at a position of the nip, and wherein at the position of the nip, a distance between said seal members is larger than a width of a layer of the developer carried on said developer carrying member out of said container, wherein said sheet has a friction resistance relative to the developer which is smaller than a friction resistance between said developer carrying member and the developer, and wherein a surface of said sheet contactable with the developer is a roughened surface.

* * * * *